United States Patent [19]

Aho

[11] 4,288,100

[45] Sep. 8, 1981

[54] BUCKLE AND STRAP AND METHOD FOR THE MANUFACTURE THEREOF, ESPECIALLY HAND STRAP AND BUCKLE FOR A SKI STICK

[76] Inventor: YrjöKuninkaantie Aho, 02160 Westend, Finland

[21] Appl. No.: 974,617

[22] Filed: Dec. 29, 1978

[30] Foreign Application Priority Data

Dec. 30, 1977 [FI] Finland ..... 773985

[51] Int. Cl.[3] ..... A63C 11/22

[52] U.S. Cl. ..... 280/821; 294/150

[58] Field of Search ..... 280/11.37 B, 11.37 D, 280/11.37 H, 821, 822; 224/54, 55, 58; 24/81 AA, 17 A, 258

[56] References Cited

U.S. PATENT DOCUMENTS

| | | | |
|---|---|---|---|
| 2,442,266 | 5/1948 | Davis | 224/58 UX |
| 3,436,090 | 4/1969 | Lange et al. | 280/11.37 H |
| 3,560,014 | 2/1971 | Bruckl | 280/11.37 H |
| 4,005,872 | 2/1977 | Rischert et al. | 280/11.37 H |
| 4,130,293 | 12/1978 | Hinterreiter | 280/11.37 H |

*Primary Examiner*—Joseph F. Peters, Jr.
*Assistant Examiner*—Michael Mar
*Attorney, Agent, or Firm*—Hill, Van Santen, Steadman, Chiara & Simpson

[57] ABSTRACT

A wrist strap and buckle arrangement is constructed as a separately removable member to be contained within a cavity space formed in the handle of a ski pole. One end of the wrist strap is permanently secured in a frame portion of the buckle and the other end of the wrist strap is freely lockable as desired between a locking lever of the buckle and the frame portion. An intermediate portion of the wrist strap extends exteriorly of the handle through a slot leading from the cavity space. The wrist strap is free of any adjustment means therealong which could gall the hand of the skier. The buckle locking lever is positioned in the open end of the cavity space so that the adjustment operation is easy to carry out.

7 Claims, 5 Drawing Figures

BUCKLE AND STRAP AND METHOD FOR THE MANUFACTURE THEREOF, ESPECIALLY HAND STRAP AND BUCKLE FOR A SKI STICK

The present invention relates to a buckle and a strap one end of which is secured to the frame portion of the buckle, the free end of the strap being attachable at desired point between the frame portion and a locking latch pivotably journaled thereto. A particular object of the invention is to fit such a buckle in connection to the hand strap of a ski stick so that the hand strap can be readily and quickly lengthened and shortened. However, the buckle and strap of the invention have a plurality of other applications, although the invention was made in connection of a ski stick's hand strap.

Another object of the invention is an economical method for the manufacture of the buckles and straps.

In known buckles, the strap end is secured to the frame portion of the buckle by folding the strap end to form a loop around a part of the buckle and by riveting or sewing the strap parts together adjacent to the attachment portion of the buckle. Such attachment requires a lot of time and expenses in the production of buckles and straps.

The object of the invention is to provide such a buckle and strap which are qualitatively better than known buckles and straps and yet substantially less expensive to manufacture.

To accomplish this object, the buckle and strap according to the invention are characterized in that the strap end is securely embedded in the body portion of an injection-moulded buckle.

The method according to the invention for the manufacture of such buckles and straps is characterized in that the strap end is fitted in the mould cavity of the buckle's body portion followed by the injection-moulding step of the body portion.

According to a preferred embodiment of the invention, one end of the strap made of synthetic fiber cord or web is provided with an anchoring hem formed by heat-cutting the strap.

The buckle of the invention is particularly suitable for use in the hand strap of a ski stick for adjustment of strap length according to the size of hand as well as for proper gripping height. A buckle, fitted in the strap in a conventional manner may, however, press or gall the hand. To overcome this drawback, the present invention proposes a new and special position and attachment for the buckle. Without limiting the invention to the construction and manufacture of the buckle and strap referred to above, the invention suggests that a separate, detachable buckle be fitted inside the cavity space in the upper part of the stick handle. Previously known are also such assemblies, wherein adjustment of the strap length is effected in the upper part or knob of the stick handle. A common constructional feature in these prior art solutions is that the grooves or notches for the hand strap are provided in the frame portion of the stick knob, i.e. in a part connected to the stick rigidly or by screw connection. In the solutions employing screw connection, the adjustment is securely maintained, but the adjustment operation itself is cumbersome and slow and requires a screw driver. A skier very seldom carries one. In the known solutions, in which adjustment is easy to carry out, the strap gradually slips and the adjusted position changes. Additional drawbacks are free hanging strap ends or limited adjustment length.

Other various advantages and features are disclosed in more detail in the following description with reference made to the embodiment illustrated in the attached drawings, in which.

Figure 1:
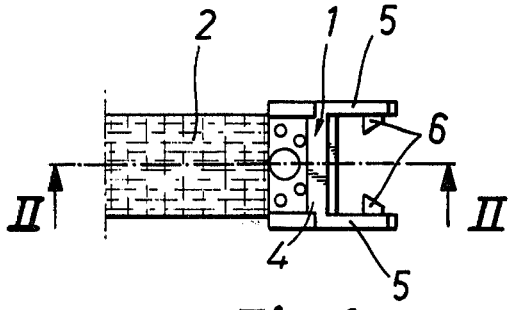
FIG. 1 is a plan view of the frame portion of the buckle of the invention with strap ends secured thereto.
Figure 2:
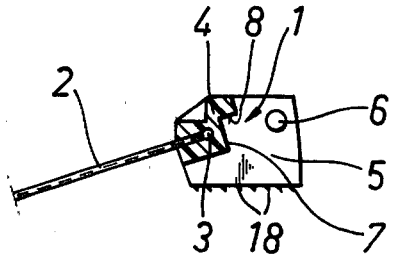
FIG. 2 is a sectional view along the line II—II in FIG. 1.

The frame portion of the buckle is made of plastics in single piece by injection-moulding. The end 3 of strap 2 made of synthetic cord or web is securely embedded in the frame portion during the injection-moulding step thereof. When straps 2 are cut off a continuous band by means of appropriately designed heating blades, the strap ends provide an anchoring hem for secure attachment. On the other hand, the material of portion 1 is under high pressure forced in between the webs or fabrics and fibers of strap 2, thus providing secure anchoring as well. The end 3 of strap 2 is tightened to the transverse beam 4 of frame portion 1 provided with two flat arms 5 projecting therefrom whose surfaces facing each other are provided with towards each other directed bearing pins 6. When making the portion 1, the dividing plane of half-moulds runs at the strap 2 and bearing pins 6 and, thus, the manufacturing can be effected by means of two half-moulds moving towards and away from each other.

Figure 3:
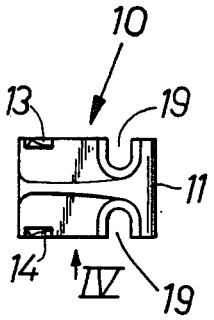
FIGS. 3 and 4 illustrate the locking lever for the buckle of the invention, which lever is attachable to the frame portion of FIGS. 1 and 2.
Figure 4:
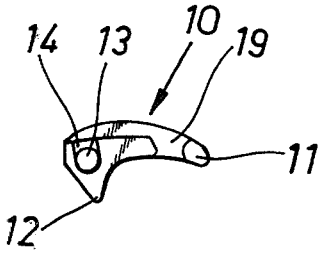
Figure 5:
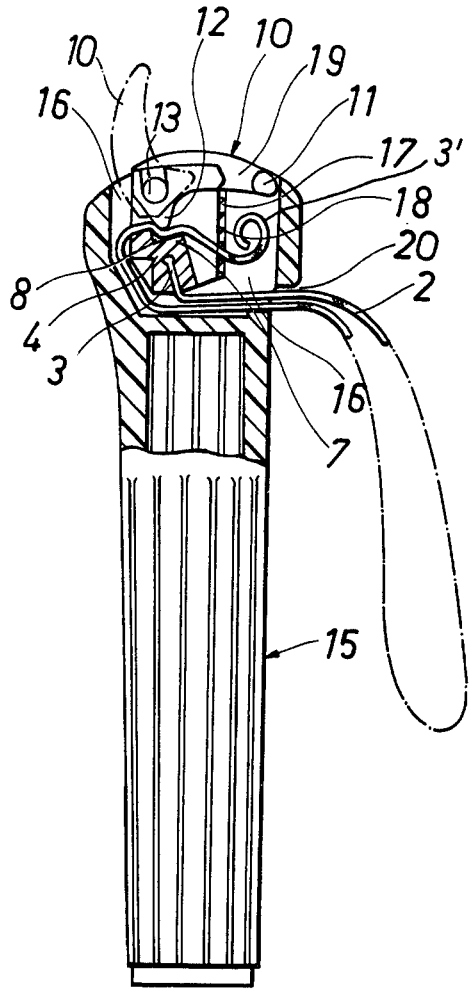
FIG. 5 shows a buckle of the invention adapted to adjusting the hand strap of a ski stick.

For locking the free end of the strap to the buckle at desired point, as depicted in FIG. 5, the buckle of the invention comprises a locking lever 10 illustrated in FIGS. 3 and 4. The side faces of the locking lever 10 are provided with recesses 13 for receiving bearing pins 6. Bevel faces 14 lead to the recesses 13, in addition to which the bevelled end faces of pins 6 as well as resilience of arms 5 facilitate inserting of lever 10 in position. With respect to its bearing axis 13, lever 10 is double-armed so that one arm 11 provides a gripping means for pivoting the lever 10 to closed and open positions, and the other arm 12 functions as a locking cam. Locking cam 12 cooperates with the transverse beam 4 of frame 1 pressing the free end 3 of strap 2 against the beam 4, as illustrated in FIG. 5. The beam 4 is provided with a shoulder 7 so that, after the cam 12 has passed the shoulder 7, the lever 10 sort of snaps in position. When the strap 2 is tightened, its free end 3 pulls the cam 12 towards another recess 8, thus providing secure and non-slipping attachment.

In the present embodiment the buckle is designed for adjusting the length of a ski stick's hand strap as seen in FIG. 5.

According to the invention, the upper part of the ski stick handle 15 is provided with a cavity space 16, inside which the buckle is inserted. The side faces of cavity space 16 comprise guide grooves or faces 17 for the attachment of frame portion 1, the frame portion 1 gripping the grooves by its engagement ribs 18. Naturally, sufficient gripping can be accomplished by tight fitting without any engagement ribs 18. In the present embodiment, the guide face 17 are formed so that the opposite side faces of cavity 16 are provided with recesses for receiving the side faces 5 of frame portion 1. The locking lever 10 acts as a cavity space 16 covering lid, when it is in the closed locking position presented by solid lines in FIG. 5. Thus, there remains sufficient space in the cavity 16 to store the free end 3 of the strap in rolled-up condition below the lever 10. When the lever 10 is pivoted to the position shown by dot-dash lines in FIG. 5, the free end 3 of the strap can be pulled in either direction for shortening or lengthening the strap 2. By turning it further, the lever 10 can be used for prying the buckle up out of the cavity 16 with the cavity's edge acting as a limit surface. Lever 10 can be opened from its closed position e.g. by means of the other stick's point, which is fitted in through a notch 19 in the edge of lever 10.

The hand strap 2 is inserted in through a slit 20 in the lower edge of the cavity space 16. With respect to the slit 20, the free end 3 of the strap is supplied from the opposite side of the beam 4, the winding of the end 3 providing tight and nonslipping attachment.

I claim:

1. Wrist strap and buckle for a ski stick located in a cavity space of a knob-shaped upper part of a handle at one end of the stick, the buckle being a separately removable member contained in the cavity space and comprising a frame portion having spaced-apart side faces and a transverse beam extending therebetween in which one end of the wrist strap is permanently secured and a locking lever pivotally journalled in said side faces over said transverse beam, a free end of the wrist strap being lockable at a desired point between a locking cam of said locking lever and said transverse beam, and an intermediate portion of the wrist strap extending exteriorly of the handle through a slot leading from the cavity space.

2. Wrist strap and buckle for a ski stick located in a cavity space of a knob-shaped upper part of a stick handle, the buckle being a separately removable member contained in the cavity space and comprising a frame portion having spaced-apart side faces and a transverse beam extending therebetween in which a wrist strap one end is permanently secured and further comprising a locking lever pivotally journalled thereto, a free end of the strap being lockable at desired points between a locking cam of said locking lever and the transverse beam, said side faces being provided with bearing pins which are extended towards each other, free ends of the bearing pins being bevelled, opposite side faces of the locking lever having corresponding recesses for receiving said bearing pins and bevelled guide faces leading to said recesses, and an intermediate portion of the wrist strap extending exteriorly of the handle through a slot leading from the cavity space.

3. Wrist strap and buckle for a ski stick located in an open cavity space of a knob part of a stick handle, the buckle being a separately removable member contained in the cavity space and comprising a frame portion having a beam to which one end of the wrist strap is permanently secured a double-armed locking lever pivotably journalled on said frame portion, an opposite free end of the wrist strap being lockable at any point therealong between a locking cam of said locking lever and the beam, the handle having a slot connected with the cavity space for extending an intermediate portion of the wrist strap exteriorly of the handle, one arm of the double-armed locking lever provides a lid covering the cavity space of the knob part when the buckle is in a locked position and another arm of the lever acts as the locking cam.

4. The wrist strap and buckle of claim 3, wherein said beam has a face portion towards which said locking cam engages when the buckle is in a locked position, said face portion being provided with steps between which the locking cam is located in the locked position of the buckle.

5. Wrist strap and buckle for a ski stick located in a cavity space of a knob-shaped upper part of a stick handle, the buckle comprising a frame portion to which a wrist strap one end is permanently secured, characterized in that the frame portion comprises a locking lever pivotably journalled thereto, a free end of the strap being lockable against an attachment member at a desired point therealong between a locking cam of said locking lever and the attachment member, the handle having a slot connected with the cavity space for extending an intermediate portion of the wrist strap exteriorly of the handle, the frame portion having side faces freely projecting from the attachment member provided with bearing pins which are extended towards each other, the ends of the bearing pins being bevelled, such that the locking lever can be used for prying the frame portion up out of the cavity space by turning the locking lever in an open position against an upper edge of the cavity space.

6. In combination, a ski handle having a tubular sleeve at one end for receiving a ski pole, the handle having a cavity at its opposite end, and a wrist strap and buckle structure mounted in assembled relation with said handle with the buckle structure having a frame portion, the buckle and strap structure including a strap having one end that is permanently secured to the frame portion of the buckle, the buckle including a locking lever pivotally mounted on the handle in said cavity, an opposite free end of the strap being attachable at a desired adjustable point along the strap, the strap being movable into various adjusted positions with respect to the buckle and inside said cavity, the cavity receiving the entire free end of the strap in curled form so that it is maintained inside of the handle cavity and is not free to project exteriorly thereof, the free end of the strap being movable in such a way that varying length of the free end of the strap can be stored inside the cavity depending on the adjustment that is made between the strap end and the buckle structure.

7. In combination, a ski handle having a cavity space containing a separately removable buckle means comprising a synthetic plastic frame portion having spaced-apart side faces and a transverse beam extending therebetween, a strap made of synthetic fiber cord, one end of said strap being securely embedded and casted inside said transverse beam and the opposite end of said strap being free, the handle having a slot connected with the cavity space for extending an intermediate portion of the wrist strap exteriorly of the handle, and a locking lever pivotally journalled to said frame portion and cooperable with said transverse beam for clamping said free end of said strap frictionally thereagainst at any position along said strap free end and for releasing said strap free end for readjustment, as desired.

* * * * *